US006261072B1

(12) United States Patent
Abe et al.

(10) Patent No.: US 6,261,072 B1
(45) Date of Patent: Jul. 17, 2001

(54) SCROLL COMPRESSOR

(75) Inventors: Nobuo Abe; Koichi Sekiguchi, both of Tochigi-ken (JP)

(73) Assignee: Hitachi, LTD, Tokyo (JP)

( * ) Notice: Subject to any disclaimer, the term of this patent is extended or adjusted under 35 U.S.C. 154(b) by 0 days.

(21) Appl. No.: 09/208,574

(22) Filed: Dec. 10, 1998

(30) Foreign Application Priority Data

Dec. 12, 1997 (JP) ..... 9-343183

(51) Int. Cl.[7] ..... F03C 2/00
(52) U.S. Cl. ..... 418/55.3; 464/102
(58) Field of Search ..... 418/55.3; 464/102

(56) References Cited

U.S. PATENT DOCUMENTS 5,125,810 * 6/1992 Suefuji et al. ..... 418/55.3
5,275,543 * 1/1994 Tanaka et al. ..... 418/55.3
5,382,144 * 1/1995 Tanaka et al. ..... 418/55.3
5,842,845 * 12/1998 Kawano et al. ..... 418/55.3

FOREIGN PATENT DOCUMENTS

0170883 * 10/1983 (JP) ..... 418/55.3
132092 7/1987 (JP) .
0201383 * 8/1988 (JP) ..... 418/55.3
63-201383 * 8/1988 (JP) ..... 418/55.3
0053084 * 3/1989 (JP) ..... 418/55.3
2176176 7/1990 (JP) .
405231348 * 9/1993 (JP) ..... 418/55.3

* cited by examiner

*Primary Examiner*—Thomas Denion
*Assistant Examiner*—Theresa Trieu
(74) *Attorney, Agent, or Firm*—Antonelli, Terry, Stout & Kraus, LLP

(57) ABSTRACT

In a scroll compressor, generation of excessive vibration attributable to a ferrous Oldham's ring is eliminated, the fatigue failure and the operation noise are prevented, and the reliability is improved. Only an Oldham's key under sliding motion is formed of a metallic bush formed of iron excellent in the reliability in slidability, and an annular part large in volume is manufactured of light metal such as aluminum, and assembled to reduce the weight. That is, the bush excellent in wear resistance is press-fitted and locked to a light Oldham's ring formed of aluminum alloy in which a projection is integrated with the annular part. Alternatively, both sides of the projection which are the sliding sides with key grooves may be formed in arc shape. In this construction, the scroll compressor is obtained, in which generation of the excessive vibration attributable to a conventional ferrous Oldham's ring is eliminated thereby, the fatigue failure and the operation noise attributable to the vibration are prevented, the reliability is high, and the fabricability is excellent.

12 Claims, 5 Drawing Sheets

SCROLL COMPRESSOR

BACKGROUND OF THE INVENTION

1. Field of the Invention

The present invention relates to a scroll compressor to be used in an air conditioner, etc., more specifically, a scroll compressor having an Oldham's ring to demonstrate the gas compression function by suppressing the rotation of an orbiting scroll, and performing the smooth turning motion relative to a fixed scroll.

2. Description of the Related Art

In a scroll compressor with the characteristics of low vibration and low noise to be used in an air conditioner for home use, etc., as indicated in FIG. 1 of Japanese Unexamined Patent Publication No. 64-32092 Official Gazette, an orbiting scroll comprising a disk-shaped end plate and a spiral wrap which is integratedly formed on the end plate in an upright manner is engaged with a fixed scroll with similar constitution to that of the orbiting scroll and having a discharge port at the center of the end plate so that side walls of the wraps are brought into contact with each other, both scrolls are stored in a cylindrical sealed container having a suction port, the fixed scroll is fixed to the sealed container, the rotation of the orbiting scroll is prevented by a rotation preventive device, a crank shaft having an eccentric part fitted to the orbiting scroll is turned by driving a motor to drive the orbiting scroll so that the center of the spiral of the wrap of the orbiting scroll is turned around the center of the spiral of the wrap of the fixed scroll while the wraps of both scrolls are kept in a contact condition.

FIG. 4 schematically shows a compression mechanism part of a well-known scroll compressor, and its structure is described in detail.

Referring to FIG. 4, the scroll compressor has a compression mechanism part 20, an orbiting scroll 21, a boss part 21*a*, a bearing 21*b*, a wrap 21*c*, a key groove 21*d*, a fixed scroll 22, a wrap 22*a*, a flange part 22*b*, a frame 23, a main bearing part 23*a*, a key groove 23*b*, a flange part 23*c*, a screw hole 23*d*, a bolt 24, a crank shaft 25, an eccentric part 25*a*, an Oldham's ring 26, an Oldham's key 26*a*, an annular part 26*b* of the Oldham's ring, a motor 27, a rotor 27*a*, a stator 27*b*, and a sealed container 28.

That is, FIG. 4 is an elevational sectional view of a well-known typical scroll compressor, and in the compression mechanism part 20, the stator 27*a* of the motor 27 is fitted through press-fitting, etc., to a lower end side of the crank shaft 25 inserted in the main bearing part 23*a* of the frame 23 as mentioned above, the bearing 21*b* provided on the boss part 21*a* of the orbiting scroll 21 is fitted to the eccentric part 25*a* of the crank shaft 25, the fixed scroll 22 whose wrap 22*a* is brought into contact and engaged with the wrap 21*c* of the orbiting scroll 21 is arranged as illustrated in the figure, and further, as shown in FIG. 5, the projected Oldham's key 26*a* which is orthogonally arranged in an integrated manner with upper and lower surfaces of the annular part 26*b* having an arbitrary thickness which is the rotation preventive mechanism of the orbiting scroll 21 is engaged with the key groove 21*d* of the orbiting scroll 21 and the key groove 23*b* of the frame 23 respectively to prevent the rotation of the orbiting scroll 21, a plurality of bolts 24 are inserted in through holes 22*c* provided in the flange part 22*b* of the fixed scroll 22, and screwed in the screw holes 23*d* provided in the flange part 23*c* of the frame 23, and the wraps 21*c*, 22*a* are regulated in alignment and tightened to complete the assembly of the compression mechanism part 20.

The stator 27*b* of the motor 27 is welded at an arbitrary position of a lower part of the sealed container 28, and the frame 23 of the sealed container 28 and the compression mechanism part 20 is locked through a plurality of spot welding between the inside diameter of the stator 27*b* and the outside diameter of the rotor 27*a* which is pre-welded to the crank shaft 25 of the compression mechanism part 20 while keeping an appropriate air gap.

In such a scroll compressor, the quantity of unbalance caused by the rotation for the orbiting scroll 21, the crank shaft 25 and the rotor 27*a* of the motor 27 can be eliminated by reducing the weight thereof through appropriate spot facing, or by adding a balance weight thereto.

However, only the Oldham's ring 26, in which its Oldham's key 26*a* is inserted in the key grooves 21*d*, 23*b* of the orbiting scroll 21 and the frame 23 respectively to prevent the rotation of the orbiting scroll 21, and the rotational motion of the eccentric part 25*a* of the crank shaft 25 is converted into the oscillating motion of the orbiting scroll 21 in order to prevent the rotation of the orbiting scroll 21, is reciprocated to generate the vibration attributable to its weight. In particular, the noise caused by the resonance, etc., of each part raises a problem in a room air conditioner for home use, etc., in which the high-speed rotation is required in the inverter control, etc.

Further, in such a well-known scroll compressor, a ferrous Oldham's ring is often used in order to improve the reliability in slidability between the Oldham's key 26*a* and the key grooves 21*d*, 23*b*, and the vibration is increased as the weight is increased compared with the Oldham's ring consisting of the light metal such as aluminum, with the result against the low-vibration and low-noise properties which are the original object for the scroll compressor.

SUMMARY OF THE INVENTION

The object of the present invention is to provide a scroll compressor to be used in the air conditioner, etc., in which the weight of the Oldham's ring is reduced while securing the reliability in slidability between the key groove and the key, generation of the conventionally experienced excessive vibration is eliminated, and the reliability is excellent.

The above-mentioned object of the present invention is achieved as follows.

Firstly, in the scroll compressor in which the orbiting scroll is provided between the frame and the fixed scroll, the fixed scroll is engaged with the orbiting scroll with their spiral wraps respectively on the inner side, the Oldham's ring is provided between the frame and the orbiting scroll, and the Oldham's key of the Oldham's ring is inserted in the key grooves of the frame and the orbiting scroll, the Oldham's ring is characterized in that the Oldham's key is provided with a wear resistant bush. The sliding wear of the Oldham's key is suppressed, and its reliability in slidability is improved thereby. Thus, the weight of the Oldham's ring itself can be reduced.

Secondly, the Oldham's ring is characterized in that its annular part and a projected part of the Oldham's key are integratedly formed of the light metal such as aluminum alloy, and the bush is locked to a sliding part between the projected part and the key groove. Thus, generation of the vibration attributable to the weight is prevented more compared with a conventional scroll compressor completely formed of steel, through the weight reduction of the Oldham's ring.

Thirdly, the Oldham's key is characterized in that the outside diameter of the projected part and the inside diameter of the bush are locked through press-fitting. Thus, the bush can be easily fitted.

Fourthly, the Oldham's key is characterized in that the outside diameter of the projected part is fitted to the inside diameter of the bush with an arbitrary clearance therebetween, and the Oldham's ring is locked to the bush by pressing the projected part to achieve the plastic flow into a recessed part provided in the side wall inside diameter of the bush. Thus, the bush can surely be fixed to the projected part, and the reliability is improved.

Fifthly, the Oldham's key is characterized in that a sliding surface side with the key groove of the projected part is formed of arc-shape, and a wear resistant bush having a flat surface parallel to the arc-shaped surface with an arbitrary clearance is fitted to the projected part. Thus, the bush can demonstrate the floating function along the arc-shaped surface, the accuracy in straightness in the sliding direction is unnecessary, and the machining cost can be reduced.

Sixthly, the scroll compressor which compresses the gas by engaging the fixed scroll and the orbiting scroll comprising the end plate and the spiral wrap erected therefrom with each other with their wraps on the inner side, and turning the orbiting scroll relative to the fixed scroll, and regulates the rotation of the orbiting scroll by inserting the Oldham's key arranged orthogonal to the upper and lower surfaces of the annular part of the Oldham's ring into the key grooves which are respectively orthogonal to the frame and the orbiting scroll, is characterized in that the Oldham's key is provided with the wear resistant bush in the sliding part with the key groove, and that the annular part and the projected part having the bush of the Oldham's ring are integratedly formed of the light metal such as aluminum alloy. Thus, because the reliability in slidability equivalent or superior to that of the conventional Oldham's ring formed of steel can be demonstrated with the wear resistant bush, and the Oldham's ring can be formed of the light metal such as aluminum, the operational vibration attributable to the reciprocation of the well-known all-steel Oldham's ring, in particular, the excessive vibration during the high-speed operation under the inverter control can be suppressed.

DESCRIPTION OF THE PREFERRED EMBODIMENT

An embodiment of the present invention will now be described with reference to the drawings.

Figure 1B:
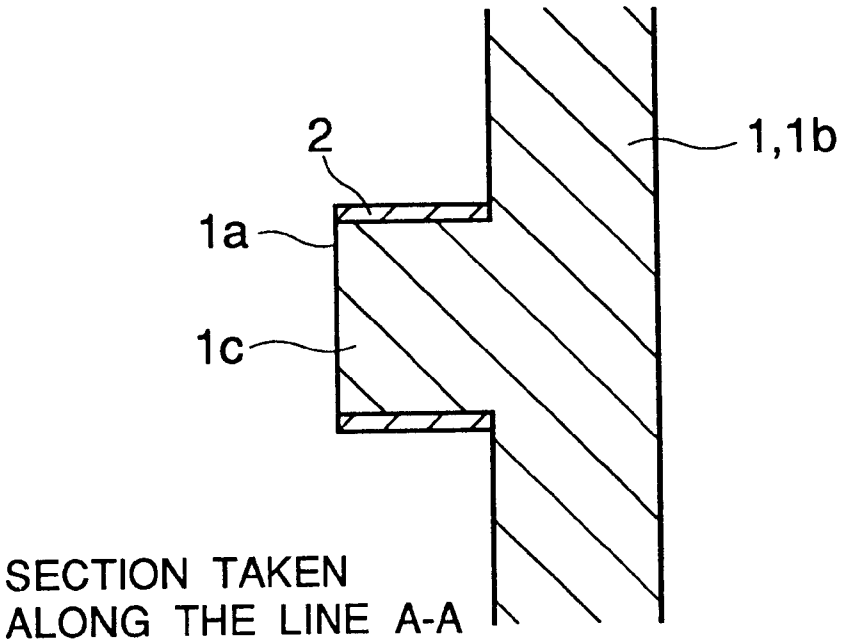
FIG. 1 is a plan view 1A and an elevational sectional view 1B of an Oldham's ring in which a projection is locked to a bush through press-fitting according to an embodiment of the present invention.
Figure 1A:
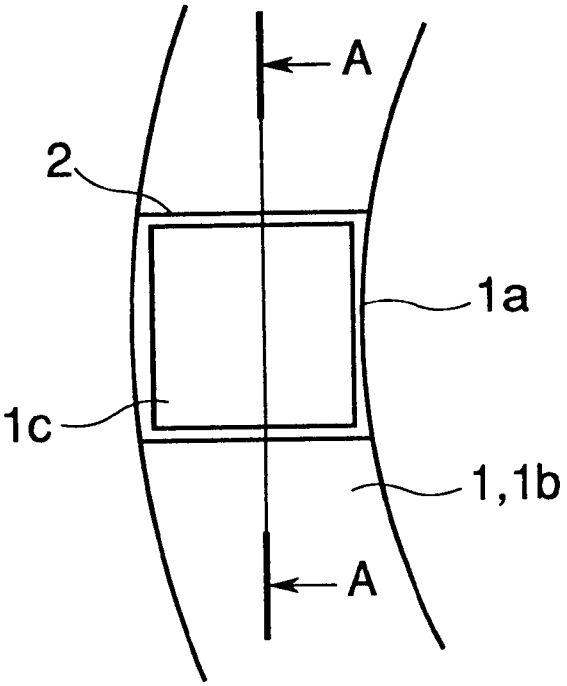
Figure 2B:
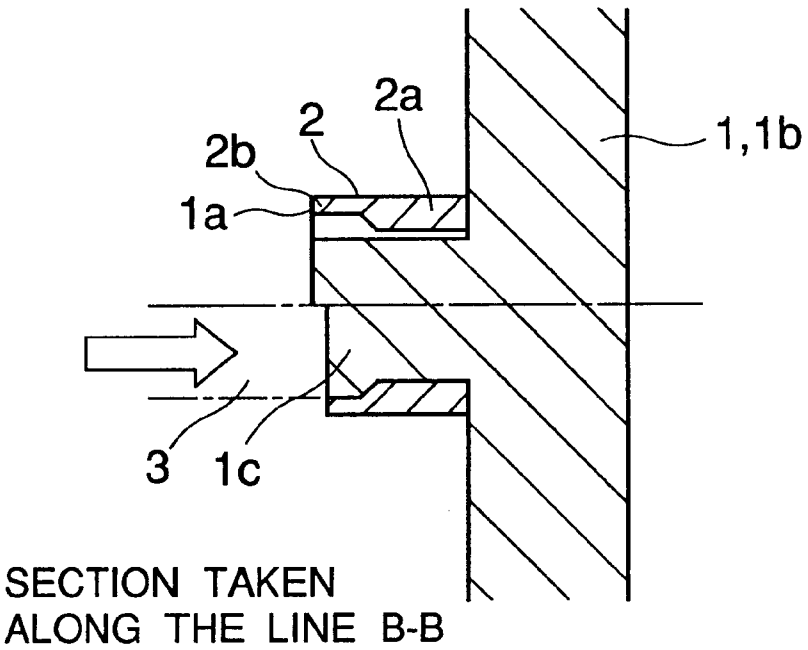
FIG. 2 is a plan view 2A and an elevational sectional view 2B of an Oldham's ring in which a projection is locked to a bush through plastic forming according to an embodiment of the present invention.
Figure 2A:
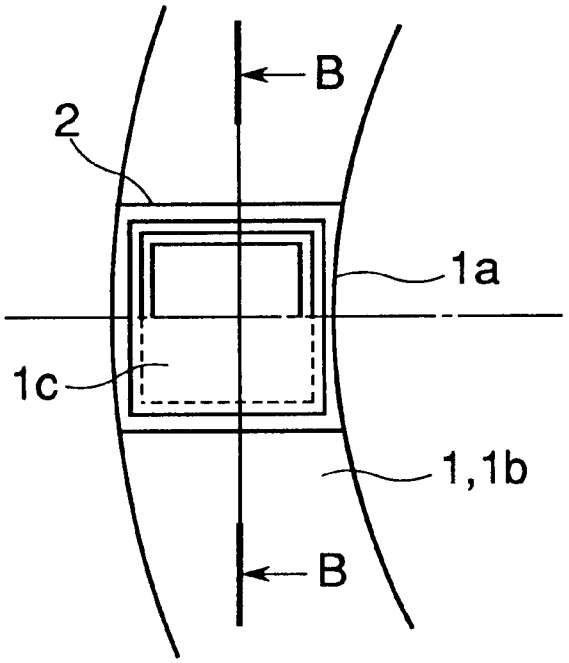
Figure 3B:
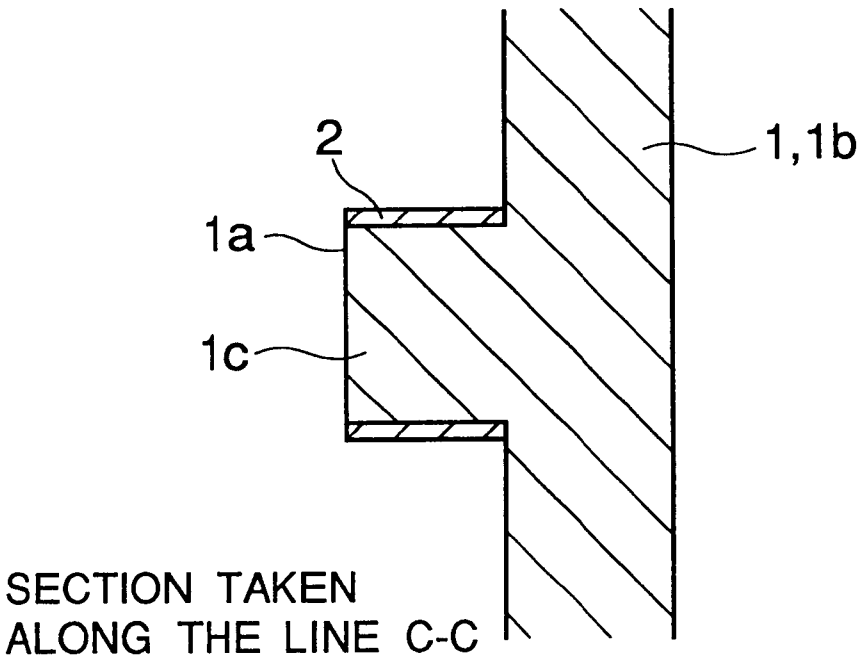
FIG. 3 is a plan, view 3A and an elevational sectional view 3B of an Oldham's ring in which a projection is locked to a bush so as to demonstrate the floating function according to an embodiment of the present invention.
Figure 3A:
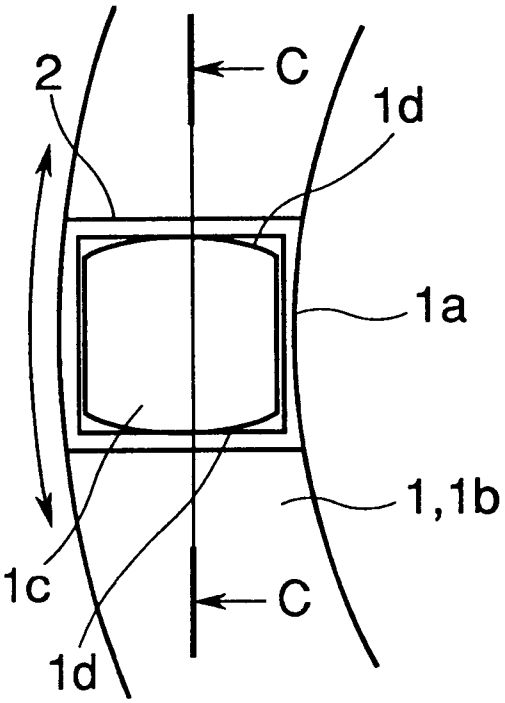

FIG. 1 through FIG. 3 illustrate one embodiment of an Oldham's ring of the present invention, and FIGS. 1A, 2A, 3A are plan views and FIGS. 1B, 2B, 3B are elevational sectional views. In these figures, the Oldham's ring has an Oldham's ring 1, an Oldham's key 1*a*, an annular part 1*b* of the Oldham's ring, a projection 1*c*, an arc-shaped side surface 1*d*, a bush 2, a side wall 2*a*, a recess 2*b* provided on the inner side of the side wall, and a push pin 3.

The Oldham's ring 1 is manufactured of the light metal such as aluminum, and the bush 2 directly sliding with a key groove is manufactured of the material of relatively high specific gravity such as ferrous sintered alloy excellent in wear resistance in the present invention. Not to speak of, the bush 2 can be manufactured of the material excellent in the wear resistance such as titanium, ceramic and carbon, not limited to ferrous materials.

FIG. 1 is a plan view 1A in which the part of the Oldham's key 1*a* at one part of the Oldham's ring 1 is expanded, and a section 1B taken along the line A—A, and in this example, the projection 1*c* of the Oldham's ring 1 is locked to the bush 2 through press-fitting.

Figure 4:
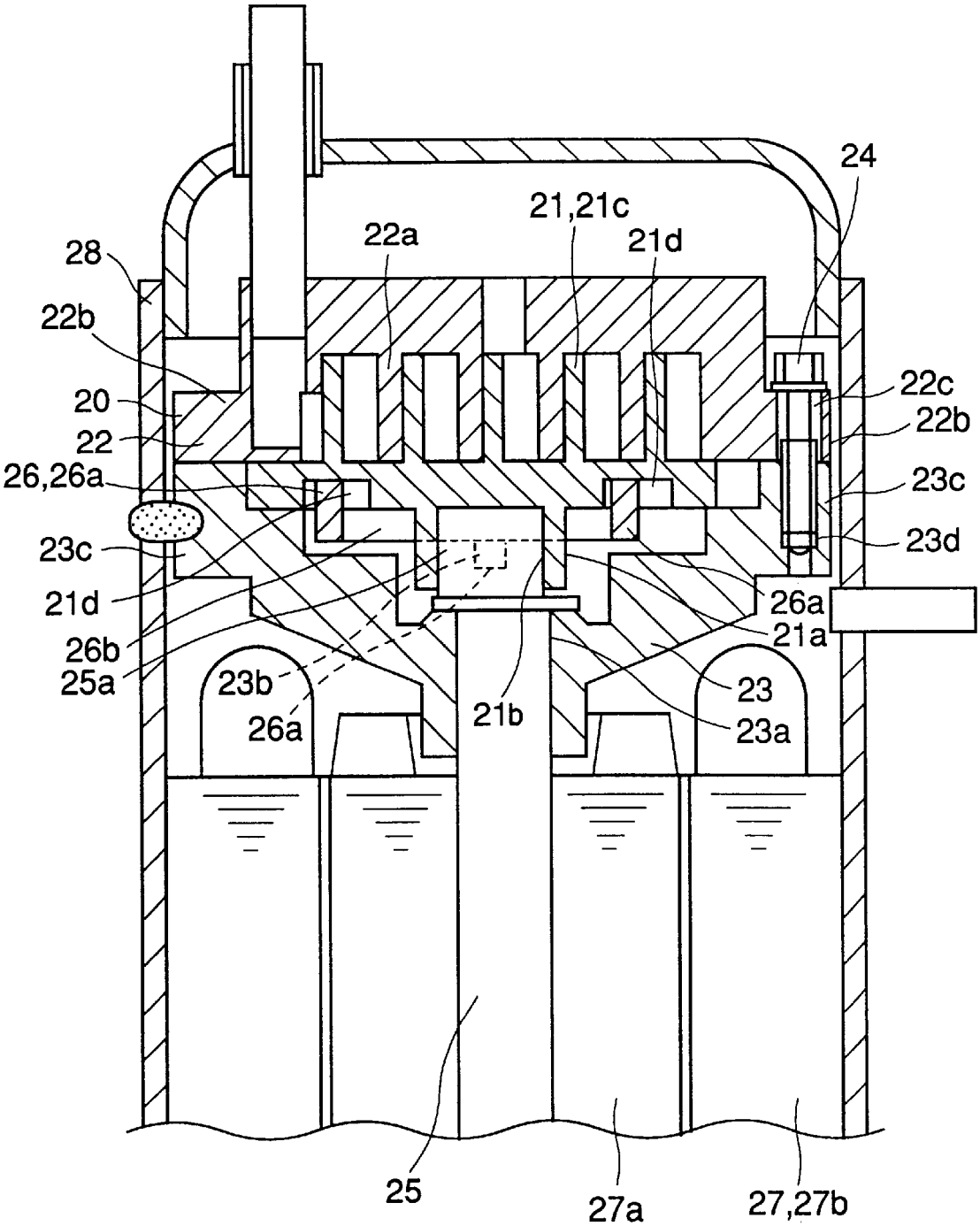
FIG. 4 is an elevational sectional view illustrating a general structure of a scroll compressor in which an Oldham's ring is built.
Figure 5A:
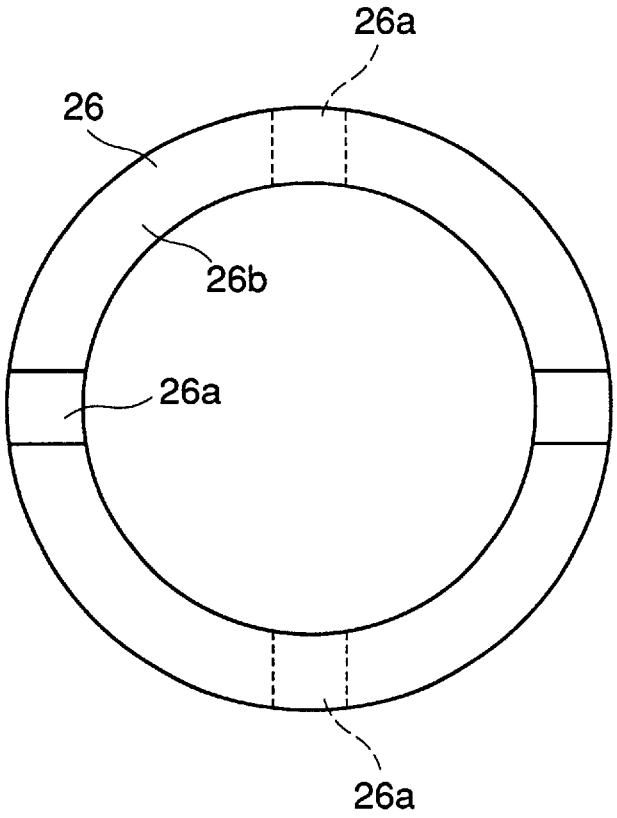
FIG. 5 is a plan view 5A and an elevational sectional view 5B of an example of a well-known Oldham's ring in which an annular part is integrated with an Oldham's key part.
Figure 5B:
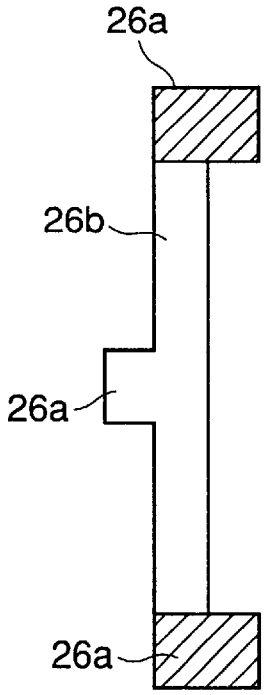

That is, in the Oldham's ring 1, the projection 1*c* is integrated with the annular part 1*b* at two parts of the upper and lower sides of the annular part 1*b* of arbitrary thickness so that the lines connecting the centers to each other are orthogonal to each other. The projection 1*c* is formed to be relatively smaller than the Oldham's key 26*a* of the Oldham's ring 26 of a well-known scroll compressor illustrated in FIG. 4 by the thickness of the side wall 2*a* of the bush 2. On the other hand, the bush 2 is formed in, for example, square shape having the side wall of arbitrary thickness, and its internal dimension is determined so as to be press-fitted in the projection 1*c*, and the bush is locked to the projection through press-fitting as illustrated in FIG. 1.

FIG. 2 is an embodiment different from that in FIG. 1, comprising a plan view 1A in which the part of the Oldham's key 1*a* is expanded, and a section 1B taken along the line B–B.

That is, the Oldham's ring 1 is similar to that in FIG. 1 in that the projection 1*c* is integrated with the annular part 1*b* at two parts of the upper and lower sides of the annular part 1*b* of arbitrary thickness so that the lines connecting the centers to each other are orthogonal to each other, but different in that, the recessed part 2*b* or a horizontal hole (not shown in the figure) is formed in its side wall 2*a* of the bush 2.

The internal dimension of the recessed part or the horizontal hole is the dimension related to the alignment with the projection 1*c*, and after fitting to the projection 1*c* with the substantially small clearance from the center line in the elevational sectional view in FIG. 2B as shown on the upper side, the projection is set to a plastic forming die (not shown in the figure), the push pin 3 (shown by the one-dot chain line) is pushed in the direction of the arrow from the center line in the elevational sectional view in FIG. 2B from the upper part of the projected part as shown on the lower side, the projection 1*c* is plastic-formed, a part thereof flows into the recessed part 2*b*, and both members are locked to each other while preventing the detachment. This is effective in that both members can be firmly fixed to each other.

FIG. 3 is an embodiment different from those in FIG. 1 or FIG. 2, and a plan view 3A in which a part of the Oldham's key 1*a* is expanded and a section 3B taken along the line C—C.

That is, the Oldham's ring 1 is similar to those in FIG. 1 and FIG. 2 in that the projection 1*c* is integrated with the annular part 1*b* at two parts of the upper and lower sides of the annular part 1*b* of arbitrary thickness so that the lines connecting the centers are orthogonal to each other, but different from the above-mentioned examples in that both sides 1*d* which are the sliding side of the projection 1*c* with the key groove (not shown in the figure) are of arc-shape of arbitrary size in this example.

In this example, the internal dimension of the bush 2 is the dimension to allow the fitting with appropriate clearance from the maximum dimension between the arc-shaped side surfaces 1*d* of the projection 1*c*, and when the projection is fitted to the bush, the floating function of the bush 2 can be demonstrated along the arc-shape of the side surfaces 1*d* as indicated by the arrow in the figure even if there is a slight error in the key groove in the manufacturing practice, and the uneven touch, etc., can be reduced.

As described above, in these embodiments, the reliability in slidability equivalent to that of a steel Oldham's ring can be demonstrated with a small bush, and the weight of the whole Oldham's ring can be reduced because the Oldham's ring is formed of the light metal such as aluminum, and the operational vibration attributable to the reciprocation which is a fatal problem with the Oldham's ring of a well-known scroll compressor fully formed of steel, in particular, the excessive vibration during the high-speed operation under the inverter control can be suppressed.

As a result, the fatigue failure attributable to the vibration and the operation noise can be reduced, and a quiet and highly reliable compressor can be provided.

Further, in the structure having the floating mechanism illustrated in FIG. 3, the machining accuracy in straightness in the sliding direction of an end face sliding with the key groove as the Oldham's key is not required in comparison with the assembly where the Oldham's ring is locked to the bush in a fixed condition as shown in FIG. 1 and FIG. 2, and the machining cost can be reduced, and an inexpensive scroll compressor can be provided.

As described above, in the scroll compressor of the present invention to be used in the air conditioner, etc., the excessive vibration experienced when a well-known Oldham's ring completely formed of steel is not generated, the fatigue failure and the operation noise attributable to the vibration are prevented, the reliability is excellent, and the machinability and fabricability are excellent.

What is claimed is:

1. A scroll compressor, wherein an orbiting scroll is provided between a frame and a fixed scroll, said fixed scroll is engaged with said orbiting scroll with their spiral wraps on the inner side, and Oldham's ring is provided between said frame and said orbiting scroll, an Oldham's key of said Oldham's ring is inserted in key grooves of said frame and said orbiting scroll, said Oldham's key of said Oldham's ring comprises a projected part of said Oldham's ring and a wear resistant bush fitted to said projected part, and said wear resistant bush is made of a material having better wear resistance than said projected part.

2. A scroll compressor according to claim 1, wherein an annular part of said Oldham's ring and said projected part of said Oldham's key are integratedly formed of the light metal, and said bush is locked to a sliding part with said key groove of said projected part.

3. A scroll compressor according to claim 2, wherein, the outside diameter of said projected part is locked to the inside diameter of said bush through press-fitting in said Oldham's key.

4. A scroll compressor according to claim 2, wherein, the outside diameter of said projected part is fitted to the inside diameter of said bush with clearance in said Oldham's key, and said Oldham's ring is locked to said bush by pressing said projected part to perform the plastic flow into a recessed part provided on the inside diameter of a side wall of said bush.

5. A scroll compressor according to claim 2, wherein said annular part of said Oldham's ring and said projected part having said bush are integratedly formed of an aluminum alloy.

6. A scroll compressor according to claim 5, wherein said bush is made of a material selected from the group consisting of a ferrous alloy, titanium, ceramic and carbon.

7. A scroll compressor according to claim 6, wherein said bush is made of a ferrous sintered alloy.

8. A scroll compressor according to claim 2, wherein, the sliding surface side with said key groove of said projected part is formed of arc shape, and a wear resistant bush having the flat surface parallel to said arc-shaped surface with arbitrary clearance is fitted to said projected part in said Oldham's key.

9. A scroll compressor, wherein, the gas is compressed by engaging a fixed scroll comprising an end plate and a spiral wrap erected therefrom with an orbiting scroll with their wraps on the inner side, and by turning said orbiting scroll relative to said fixed scroll, the rotation of said orbiting scroll is regulated by inserting an Oldham's key arranged orthogonal to upper and lower sides of an annular part of an Oldham's ring in key grooves respectively provided orthogonal to said frame and said orbiting scroll, said Oldham's key comprises a projected part of said Oldham's ring and a wear resistant bush on a sliding part with said key grooves fitted to said projected part, and said wear resistant bush is made of a material having better wear resistance than said projected part, and said annular part of said Oldham's ring and said projected part having said bush are integratedly formed of light metal.

10. A scroll compressor according to claim 9, wherein said annular part of said Oldham's ring and said projected part having said bush are integratedly formed of an aluminum alloy.

11. A scroll compressor according to claim 10, wherein said bush is made of a material selected from the group consisting of a ferrous alloy, titanium, ceramic and carbon.

12. A scroll compressor according to claim 11, wherein said bush is made of a ferrous sintered alloy.

* * * * *